United States Patent [19]

Croudace et al.

[11] Patent Number: 4,720,288

[45] Date of Patent: Jan. 19, 1988

[54] GASOLINE FUEL COMPOSITION

[75] Inventors: Michael C. Croudace, Huntington Beach; Ward W. Howland, Anaheim, both of Calif.

[73] Assignee: Union Oil Company of California, Los Angeles, Calif.

[21] Appl. No.: 844,867

[22] Filed: Mar. 27, 1986

[51] Int. Cl.[4] ..... C10L 1/22

[52] U.S. Cl. ..... 44/72; 44/76

[58] Field of Search ..... 44/72, 76

[56] References Cited

U.S. PATENT DOCUMENTS

| | | | |
|---|---|---|---|
| 2,297,114 | 9/1942 | Thompson | 44/69 |
| 2,387,537 | 10/1945 | Smith et al. | 260/461 |
| 2,656,372 | 10/1953 | Ernst et al. | 260/461 |
| 2,765,220 | 10/1956 | Yust et al. | 44/69 |
| 2,863,742 | 12/1958 | Cantrell et al. | 44/72 |
| 2,863,743 | 12/1958 | Pellegrini et al. | 44/69 |
| 2,863,746 | 12/1958 | Cantrell et al. | 44/69 |
| 2,863,747 | 12/1958 | Cantrell et al. | 44/72 |
| 2,863,904 | 12/1958 | Cantrell et al. | 44/72 |
| 2,905,542 | 9/1959 | Gottshall et al. | 44/72 |
| 2,948,600 | 8/1960 | Larson | 44/69 |
| 2,959,473 | 11/1960 | Andress | 44/76 |
| 2,988,434 | 6/1961 | Gottshall et al. | 44/72 |
| 2,999,739 | 9/1961 | Heron | 44/69 |
| 3,004,838 | 10/1961 | Larson | 44/69 |
| 3,007,782 | 11/1961 | Brown et al. | 44/72 |
| 3,035,905 | 5/1962 | Keller | 44/58 |
| 3,079,339 | 2/1963 | Cantrell et al. | 252/32.5 |
| 3,228,758 | 1/1966 | Bauer | 44/72 |
| 3,384,466 | 5/1968 | Popkin | 44/72 |
| 3,807,974 | 4/1974 | Kerley et al. | 44/58 |

FOREIGN PATENT DOCUMENTS 910630 10/1971 Canada .

OTHER PUBLICATIONS

SAE Paper 861550 entitled "Exhaust Valve Recession with Low-Lead Gasolines" by Schoonveld et al.

SAE Paper 860090 entitled "The Effects of Low-Lead and Unleaded Fuels on Gasoline Engines" by Weaver.

SAE Paper 710368 entitled "Valve Problems with Lead Free Gasoline" by Giles.

SAE Paper 710674 entitled "Influence of Low-Lead Fuels on Exhaust Valve Performance" by Giles et al.

"Role of Lead Antiknocks in Modern Gasoline" by Pahnke et al. of E. I. duPont de Nemours & Co. as set forth in SAE Transactions, vol. 80, Paper No. 710842, 1971.

"The Effect of Some Fuel and Operating Parameters on Exhaust Valve Seat Wear" by W. L. Kent and F. T. Finnigan, Society of Automotive Engineers, Inc. Paper No. 710673.

*Primary Examiner*—William R. Dixon, Jr.

*Assistant Examiner*—Margaret B. Medley

*Attorney, Agent, or Firm*—Dean Sandford; Gregory F. Wirzbicki

[57] ABSTRACT

Amine salts of orthophosphoric acid or its ester, when dissolved in unleaded gasoline in an effective amount, reduce the erosion of non-hardened exhaust valve seats in automotive engines operating on said gasoline. The preferred salts are the amine salts of branched chain primary alkyl acid esters of orthophosphoric acid.

215 Claims, 2 Drawing Figures

GASOLINE FUEL COMPOSITION

BACKGROUND OF THE INVENTION

This invention relates to fuel compositions, and more particularly to gasoline fuel compositions, and more particularly still, to unleaded gasoline fuel compositions containing an additive to reduce the wear on non-hardened, automotive exhaust valve seats, such as exhaust valve seats composed of cast iron.

Valve recession is the process whereby the exhaust valve seats in an internal combustion, four-stroke engine are worn away by metal-to-metal contact with the valves during high speed, heavy-load conditions. As the valve seat is worn away, the valve becomes recessed in the engine head which results in loss in valve lash to the point of poor seating, valve burning and substantial power losses. If the conditions continue, severe engine damage will result which can eventually cause engine failure.

Cars subject to valve seat recession are generally limited to cars built prior to 1971. After 1971, valve and valve seats in automotive engines were hardened by a heat-treating process which eliminated the problem. Pre-1971 and many post-1971 trucks also have non-hardened seats and are subject to valve seat recession with unleaded gasolines.

For years the automotive industry has recognized that alkyl lead antiknock compounds are effective additives for preventing exhaust valve seat wear. Apparently, lead oxide coats the valve seats, lubricating and protecting these surfaces. The protection offered by lead additives is sufficient even at concentrations as low as 0.1 grams (as Pb) per gallon of fuel. However, somewhere between about 0.075 and 0.1 grams per gallon, lead additives lose their effectiveness in preventing valve recession. Thus, for operation with "unleaded" fuels (i.e., those containing no more than about 0.05 grams of lead per gallon), it can be seen that the wear on the valve seat is greater than that for leaded fuels containing 0.1 grams per gallon or more of lead. In fact, the rate of valve recession can be as much as 25 to 50 times as great, and it has been reported (in U.S. Pat. No. 3,898,055 issued to Bray) that the exhaust valves in an engine operating at full load on unleaded fuel can "sink" or recess as much as 1 to 5 mm. in only 10 hours. Obviously, such excessive wear rates cannot be tolerated, and with leaded fuels being phased out due to governmental regulations, the need for a non-leaded gasoline additive to prevent valve recession is vital.

It is, of course, known that tricresyl phosphate is somewhat effective for this purpose, as reported, for example, in U.S. Pat. No. 3,807,794 issued to Kerley et al. and in SAE Paper No. 710673 by Kent and Finnegan entitled "The Effect of Some Fuel and Operating Parameters on Exhaust Valve Seat Wear" published in 1971. However, tricresyl phosphate has one major detrimental property which has prevented its use on a commercial scale, namely, that it is extremely toxic.

It is, therefore, an object of the present invention to provide an unleaded gasoline composition containing sufficient of a relatively non-toxic additive to prevent or reduce the wear associated with unhardened exhaust valve seats of internal combustion engines.

SUMMARY OF THE INVENTION

In the present invention, it has been found that excessive wear of exhaust valve seats in an internal combustion engine, such as an automotive engine, can be prevented when operating on low lead or unleaded gasoline fuels by introducing into the fuel an additive containing a gasoline-soluble amine salt of an acid of phosphorus or an ester thereof. Such additives are introduced into the fuel in an amount at least sufficient to reduce the wear rate of the exhaust valve seats as compared to the same fuel without the additive.

BRIEF DESCRIPTION OF THE DRAWING

In the drawing are two graphs depicting data obtained from the experiments described in the Example hereinafter.

DETAILED DESCRIPTION OF THE INVENTION

Figure 1:
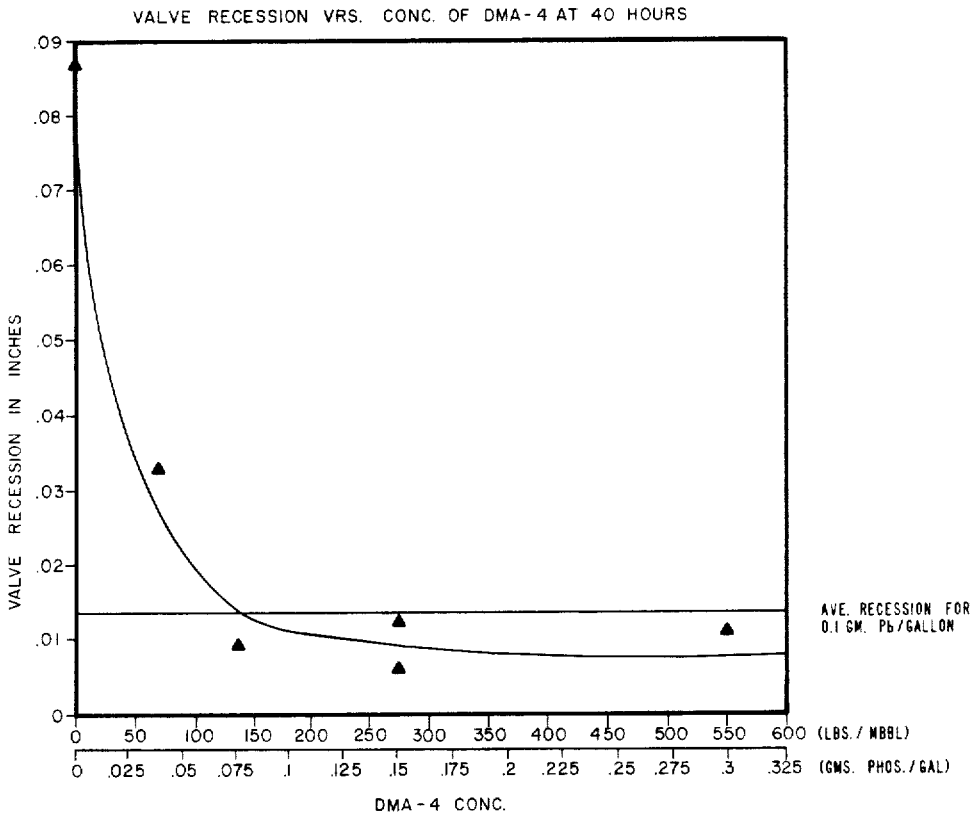
In FIG. 1 are shown the data relating to the amount of valve recession after 40 hours of engine operation with gasolines containing varying concentrations of an amine salt of an alkylacid ester of orthophosphoric acid.

The present invention is directed to overcoming or substantially reducing the valve recession phenomenon associated with the operation of an internal combustion engine running on unleaded gasoline fuel. In the invention, an additive containing one or more gasoline-soluble phosphorus compounds, typically and preferably having a relatively high boiling point, i.e., at or above 300° C., is combined with the unleaded fuel prior to introduction into the combustion chambers of the engine. Preferably, the additive contains phosphorus only in compounds having a boiling point at or above 300° C., said additive being introduced into the fuel so as to provide a concentration therein effective to reduce the rate of wear of the engine exhaust valve seats.

Among the phosphorus compounds useful in the invention are the gasoline-soluble amine salts of a phosphoric acid or ester thereof. Thus, the compound may, for example, be a partially or fully neutralized product between one or more organic amines and an acid of phosphorus, e.g., hydrophosphoric acid, metaphosphoric acid, pyrophosphoric acid, but preferably orthophosphoric acid. By "partially or fully neutralized," it is meant that the compound may have one or more, or, indeed, all, of the acidic hydrogen atoms associated with the phosphoric acid replaced with an organic ammonium cation. Hence in the usual case, wherein orthophosphoric acid or an organic orthophosphoric acid is the chosen acid, the resulting salt may have between one and three of the acidic hydrogen atoms of the orthophosphoric acid replaced with an organic amine or one or two in the case of the organic phosphoric acid.

The preferred phosphorus compounds for use in the invention are the gasoline-soluble amine salts of esters of orthophosphoric acid. Such compounds include salts which may be represented by one of the following two formulae:

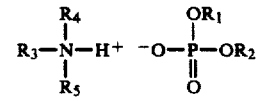

(I)

-continued

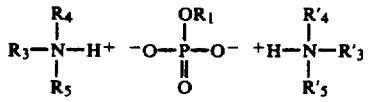

(II)

wherein $R_2$, $R_3$, and $R'_3$ are the same or different organic radicals and $R_1$, $R_4$, $R'_4$, $R_5$, and $R'_5$ are independently selected from the group consisting of hydrogen and organic radicals. (By "organic radicals," it is herein meant to include all radicals containing at least one carbon atom.) The organic radicals in the above two formulae may be either aliphatic or aromatic and may be either substituted or unsubstituted and may contain heteroatoms (i.e., oxygen, sulfur, or nitrogen), as desired. Additionally, the aliphatic radical may be acyclic or alicyclic or straight or branched chained, and may, for example, be a substituted or unsubstituted alkyl, alkenyl, or alkynyl group. Typically, when any of $R_1$, $R_2$, $R_3$, $R'_3$, $R_4$, $R'_4$, $R_5$, and $R'_5$ are organic radicals, said radicals independently contain between 1 and 50 carbon atoms, usually at least 3 carbon atoms and no more than 40 carbon atoms.

In the most preferred embodiment of the invention, the phosphorus compound is an amine salt of an alkylacid ester of orthophosphoric acid, with it being understood that such esters have one or two of the three acidic hydrogen atoms replaced by an alkyl group. Such compounds have a formula as set forth above in (I) or (II) wherein $R_1$ is either hydrogen or an alkyl group, $R_2$ is an alkyl group, and $R_3$ and $R'_3$ are organic radicals, but most preferably aliphatic radicals, and $R_4$, $R'_4$, $R_5$, and $R'_5$ are either hydrogen or an organic radical, with aliphatic radicals given preference over aromatic radicals and with hydrogen given preference over any organic radical. When $R_3$, $R'_3$, $R_4$, $R'_4$, $R_5$, and $R'_5$ are aliphatic radicals, they may be the same or different, acyclic or alicyclic, but usually contain at least 3 carbon atoms, preferably from 6 to 24 carbon atoms, and most preferably from 8 to 18 carbon atoms. Normally, when $R_3$, $R'_3$, $R_4$, $R'_4$, $R_5$, and $R'_5$ are aliphatic radicals, all carbon atoms bonded to the nitrogen atom will be saturated, with preference being given for $R_3$, $R'_3$, $R_4$, $R'_4$, $R_5$, and $R'_5$ being independently either an unsubstituted alkyl or alkenyl radical, although hydrogen is more preferred than either as to $R_4$, $R'_4$, $R_5$, and $R'_5$. It is also highly preferable, in this embodiment of the invention, that $R_2$ be a branched chain alkyl group, preferably an unsubstituted branched chain alkyl group of at least 13 carbon atoms, usually from 13 to 16 carbon atoms; the same is true for $R_1$, when $R_1$ is selected to be an alkyl group. The branching in $R_1$ and $R_2$, in accordance with this embodiment of the invention, is most preferred to occur at a location other than on the carbon atom directly bonded to the oxygen atom of the above formula. In that case, the resulting compound may be termed an amine salt of a branched chain primary alkyl acid ester of orthophosphoric acid (or a primary alkyl phosphate neutralized with an amine), which compounds are more fully described in U.S. Pat. No. 3,228,758 issued to Bauer, herein incorporated by reference in its entirety. The compounds therein described fall within the most preferred for use in the present invention, with the best mode of the present invention being practiced when a primary amine is employed and the ester is a diester, i.e., when $R_4$ and $R_5$ of the above formula (I) are both hydrogen and both $R_1$ and $R_2$ are the described branched chain alkyl radicals.

The presently preferred additive for commercial application is sold under the designation DMA-4 by E. I. duPont de Nemours and Company. Although the exact composition of DMA-4 is believed to be proprietary, it is known that DMA-4 does conform to the above formula (I) wherein $R_1$ and $R_2$ each contain 16 to 33 carbon atoms, believed to be branched chain alkyl groups, $R_3$ is an ethylhexyl group, believed to be 2-ethylhexyl, and $R_4$ and $R_5$ are both hydrogen.

Suitable amine salts for use in the invention may be prepared as the gasoline-soluble product of the reaction between an acid of phosphorus with one or more amines. However, in the preferred embodiment, wherein an amine salt of an organic phosphate (i.e., an amine salt of a phosphoric acid ester) is desired, such salts usually require a reaction between a phosphorus oxide, such as phosphorus pentoxide ($P_2O_5$), with one or more alcohols to form a mono- or diester thereof, followed by neutralization with one or more amines, such as a primary, secondary, or tertiary amine. In preparing such salts, one may employ the stoichiometric amounts. In the case of a reaction involving $P_2O_5$ with the alcohol followed by reaction with the amine, the stoichiometric molar ratio is 2:1:4, alcohol to $P_2O_5$ to amine, when the monoester is desired, and 4:1:2 when the diester is desired. For reactions involving orthophosphoric acid, the stoichiometric molar ratio is 1:1:2, alcohol to acid to amine, for the monoester and 2:1:1 for the diester. Obviously, however, the use of stoichiometric amounts is not critical; one could use more or less than the stoichiometric amounts, with excess reactant remaining, which may or may not be desirable, depending upon individual circumstances. Methods of producing salts by the foregoing procedures are taught in greater detail in U.S. Pat. No. 3,228,758 issued to Bauer, U.S. Pat. No. 3,384,466 issued to Popkin, U.S. Pat. No. 2,863,742 issued to Cantrell et al., and U.S. Pat. No. 2,863,904 issued to Cantrell et al., all of which are herein incorporated by reference in their entireties. The preparation methods for the amine salts useful in the most preferred embodiment are taught in the Bauer patent, wherein it is disclosed that a primary alcohol containing a branched chain alkyl group of at least 13 carbon atoms is reacted with phosphorus pentoxide, using 2 to 4 moles of the alcohol to react with the phosphorus pentoxide, and with 3 moles providing roughly a 50—50 mixture of the di- and monoesters. The reaction may be effectuated over a 12-hour time period at 65° C., following which the product is reacted at a temperature below 65° C. with 2 moles of an amine, preferably a primary amine such as 2-ethylhexylamine, to produce a salt useful in the invention.

The fuels into which the phosphorus additive are introduced comprise low lead or unleaded gasoline and usually consist essentially of low lead or unleaded gasolines. Low lead and unleaded gasolines, by definition herein, contain less than 0.1 and no more than 0.05 gram lead (Pb) per gallon, respectively. The typical gasoline for use in the present invention finds use in any gasoline-powdered, spark-ignition, internal combustion engine, but particularly in automotive internal combustion engines. Such engines usually operate on gasolines having a boiling range between about 80° F. and about 430° F., preferably between about 90° and 430° F., and typically have motor (MON) and research (RON) octane numbers of at least 80 and 90, respectively, with such high octane numbers, of course, being provided herein without the use of lead compounds, such as tetraethylead.

The source of the gasoline is not critical; it may be derived from straight-run naphtha, alkylate gasoline, polymer gasoline, isomerized stocks, thermally or catalytically cracked hydrocarbon stocks, and hydrocracked and catalytically reformed stocks. In addition, the gasoline may be derived from a petroleum crude oil or from synthetically prepared oils, such as shale oil and oils derived from coal. The typical gasoline used in the invention contains olefins, generally in a proportion above about 5 percent by volume, oftentimes in a proportion above about 7 percent by volume.

In addition to the phosphorus additive described above, the gasoline may further contain any of a number of known non-leaded additives. Typical of such additives are anti-icing agents, detergents, demulsifiers, corrosion inhibitors, dyes, deposit modifiers, octane improvers, and dispersants.

The amount of the phosphorus additive introduced into the gasoline is that amount necessary to cause at least some reduction in valve recession for those engines employing unhardened exhaust valve seats, such as cast iron exhaust valve seats. It has been found, however, for the amine salt of an organic acid phosphate known as DMA-4, that at least 100 pounds of additive per thousand barrels of gasoline are needed to reduce the valve recession characteristics to levels similar to that achieved with leaded fuels. Preferably, however, at least about 160, and more preferably at least about 200 pounds of additive are utilized, with concentrations above about 750 pounds per thousand barrels not usually offering any increased benefit for increased amounts of additive. At present, the most preferred range is from about 200 to about 550 pounds per thousand barrels, with 275 pounds per thousand barrels being the presently contemplated commercial optimum.

For amine salt additives other than DMA-4, the amounts required will depend on their phosphorus content. That is to say, other amine salts of an acid or ester of phosphorus should be used in concentrations so as to provide the same amount of phosphorus as DMA-4. The equivalent phosphorus concentration (in grams phosphorus as P per gallon) for other additives to provide the same phosphorus content as for DMA-4 can be obtained by multiplying the values given above for DMA-4 by $5.454\times10^{-4}$. For these other additives, the preferred levels, more preferred, etc., will be the equivalent as stated for DMA-4. Thus, for example, the commercial optimum for DMA-4 being 275 pounds of additive per thousand barrels of gasoline, the commerical optimum for other additives will be that amount which provides 0.15 grams of phosphorus (as P) per gallon.

The effectiveness of the described amine salts of organic phosphates for reducing exhaust valve seat wear when an automotive engine is operated on unleaded fuel is demonstrated in the following Example. The Example is provided to illustrate the invention, not to limit the invention as defined in the claims.

EXAMPLE

A Chevrolet automotive engine having a 350-cubic-inch displacement and also having new heads with unhardened exhaust valve seats was placed on a dynamometer test stand. Two carburetors were used with the engine, one feeding fuel to four cylinders and the other to the other four. This allows the engine to be run, with both the test fuel and a reference unleaded fuel, so that the wear on the exhaust valve seats could be measured and compared against that of the reference. The reference gasoline differs from the test feed only in that it contains no additive for reducing exhaust valve recession.

The test procedure is as follows. The engine is operated on an alternating two-step cycle taking 4 minutes to complete. The engine first idles for 36 seconds at 1,000 rpm and then runs at 3,000 rpm for 204 seconds with a load of 160 pounds (120 horsepower). This cycle is equivalent to operating an automobile at a speed of 80 miles per hour while pulling a trailer uphill. The test is stopped at 20, 40, and 60 hours of operation, and the valve recession of each exhaust valve is measured and the average is determined for the valves associated with the four cylinders running on the test fuel, and also for the reference. After each test to determine the effectiveness of a given additive, a new head with new exhaust valve seats was installed in the engine.

The foregoing test procedure was employed to test the following fuels:

(1) Unleaded fuels containing varying concentrations of DMA-4 additive, i.e., 69, 138, 275, and 550 pounds per thousand barrels, with the test at 275 pounds per thousand barrels being run twice;

(2) Leaded fuel containing 0.1 gram lead (Pb) per gallon; and (3) Unleaded fuel containing tricresyl phosphate in a concentration so as to provide 0.3 gram phosphorus (P) per gallon of gasoline.

Figure 2:
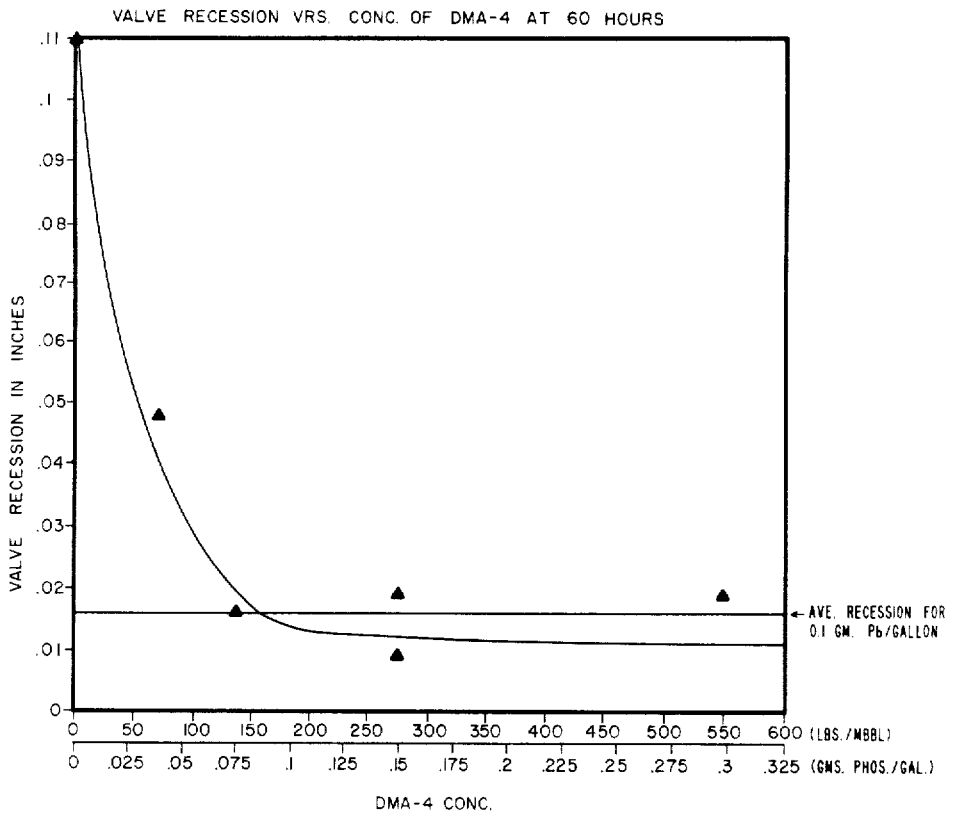
FIG. 2 is a similar graph, but depicting the results obtained after 60 hours operation with the same additive.

The data obtained from the experiment are shown in the following Table, with the data obtained at 40 and 60 hours being also shown graphically in FIGS. 1 and 2, respectively.

TABLE

| | Inches of Recession after | | |
|---|---|---|---|
| | 20 Hrs | 40 Hrs | 60 Hrs |
| Reference* | 0.0575 | 0.0870 | 0.1095 |
| Lead, 0.1 gm Pb/gal. | 0.0095 | 0.0134 | 0.0164 |
| DMA-4, 68.75 lbs/Mbbl | 0.0153 | 0.0326 | 0.0475 |
| DMA-4, 137.5 lbs/Mbbl | 0.0027 | 0.0091 | 0.0163 |
| DMA-4, 275 lbs/Mbbl | 0.0030 | 0.0057 | 0.0088 |
| DMA-4, 275 lbs/Mbbl | 0.0055 | 0.0121 | 0.0189 |
| DMA-4, 550 lbs/Mbbl | 0.0043 | 0.0108 | 0.0188 |
| Tricresyl Phosphate, 0.3 gm P/gal | 0.0054 | 0.0133 | 0.0215 |

*Average of all runs using the unleaded fuel as the reference.

As the data in the table and the drawing clearly show, the DMA-4 additive is remarkably effective for reducting exhaust valve seat recession. Specifically, when the additive is used in concentrations above about 100 pounds per thousand barrels (0.05 gram of phosphorus per gallon), it is highly effective for reducing valve recession to levels equal to or better than that provided by 0.1 gram per gallon of lead. Similarly, the data show, at 550 pounds per thousand barrels of DMA-4 additive (0.3 gram phosphorus (P) per gallon), that DMA-4 clearly provides better protection than that offered by the equivalent dosage of phosphorus added as tricresyl phosphate.

In view of the foregoing, it is evident that the invention is capable of many alternatives, modifications, variations, and embodiments. It is intended to encompass within the invention all such alternatives, modifications, variations, and embodiments as fall within the spirit and scope of the following claims.

We claim:

1. A fuel composition comprising (1) an olefin-containing gasoline which causes an excessive wear rate of exhaust valve seats when combusted in an internal combustion engine containing non-hardened exhaust valve seats and (2) a sufficient amount of an amine salt of an acid of phosphorus dissolved in said gasoline to provide a dissolved concentration of phosphorus in the gasoline of at least about 0.06 gram per gallon.

2. A fuel composition comprising (1) an olefin-containing gasoline which causes an excessive wear rate of exhaust valve seats when combusted in an internal combustion engine containing non-hardened exhaust valve seats and (2) a sufficient amount of an amine salt of an acid of phosphorus dissolved in said gasoline to reduce the wear rate of said exhaust valve seats to a level no greater than that obtainable with tetraethyl lead provided to the same gasoline in a concentration of 0.1 gram of lead per gallon.

3. A gasoline fuel containing less than 0.1 gram per gallon of lead and an amine salt of an ester of orthophosphoric acid provided in an amount sufficient to provide a dissolved concentration of phosphorus in the gasoline of at least about 0.06 gram per gallon.

4. A gasoline fuel as defined in claim 3 wherein said amine salt is of formula:

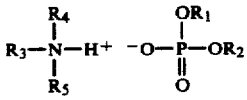

(I)

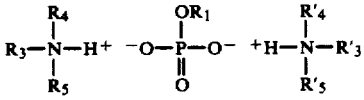

(II)

wherein $R_2$, $R_3$, and $R'_3$ are the same or different organic radicals and $R_1$, $R_4$, $R'_4$, $R_5$, and $R'_5$ are independently selected from the group consisting of hydrogen and organic radicals.

5. A gasoline fuel as defined in claim 3 wherein said amine salt is of formula:

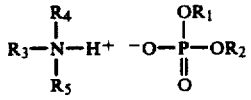

(I)

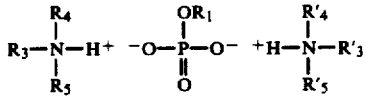

(II)

wherein $R_2$, $R_3$, and $R'_3$ are the same or different aliphatic radicals and $R_1$, $R_4$, $R'_4$, $R_5$, and $R'_5$ are independently selected from the group consisting of hydrogen and aliphatic radicals.

6. A gasoline fuel as defined in claim 5 wherein said amine salt is provided in said gasoline in an amount sufficient to provide a dissolved phosphorus concentration in the gasoline of at least about 0.11 gram per gallon.

7. A gasoline fuel as defined in claim 4 wherein $R_2$, $R_3$, and $R'_3$ contain from 5 to 20 carbon atoms and $R_1$, $R_4$, $R'_4$, $R_5$, and $R'_5$, when selected to be organic radicals, contain from 5 to 20 carbon atoms, and said amine salt is provided in an amount so as to provide a dissolved phosphorus concentration in the gasoline of at least 0.088 grams per gallon.

8. An unleaded gasoline fuel containing an amine salt of an alkylacid ester of orthophosphoric acid in an amount sufficient to provide a dissolved concentration of phosphorus of at least about 0.06 gram per gallon.

9. An unleaded gasoline fuel as defined in claim 8 wherein said amine salt conforms to formula:

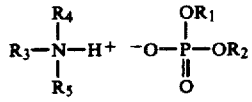

(I)

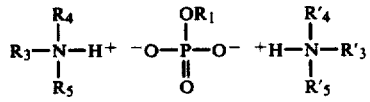

(II)

wherein $R_1$ is either hydrogen or an alkyl group, $R_2$, $R_3$ and $R'_3$ are the same or different organic radicals, $R_4$, $R'_4$, $R_5$, and $R'_5$ are independently either hydrogen or an organic radical.

10. An unleaded gasoline fuel as defined in claim 9 wherein $R_3$, $R'_3$, $R_4$, $R'_4$, $R_5$, and $R'_5$ are aliphatic radicals.

11. An unleaded gasoline fuel as defined in claim 9 wherein $R_3$ and $R'_3$ are aliphatic radicals, and $R_4$, $R'_4$, $R_5$, and $R'_5$ are all hydrogen.

12. An unleaded gasoline fuel as defined in claim 10 wherein all of said aliphatic radicals contain from 5 to 25 carbon atoms.

13. An unleaded gasoline fuel as defined in claim 11 wherein a carbon atom in $R_3$ and $R'_3$ is bonded to the nitrogen atom and is fully saturated.

14. An unleaded gasoline fuel as defined in claim 13 wherein $R_2$ is a branched chain alkyl group, with the branching occurring at a location other than at the carbon atom bonded to the oxygen atom.

15. An unleaded gasoline fuel as defined in claim 14 wherein $R_1$ is a branched chain alkyl group, with the branching occurring at a location other than at the carbon atom bonded to the oxygen atom.

16. An unleaded gasoline fuel as defined in claim 15 wherein said branched chain alkyl groups are unsubstituted.

17. An unleaded gasoline fuel as defined in claim 16 wherein $R_1$ and $R_2$ independently contain at least 13 carbon atoms.

18. A low lead gasoline fuel containing olefins and an additive in a sufficient amount to provide a dissolved phosphorus concentration of at least 0.088 grams per gallon, said additive consisting essentially of the reaction product of an amine and an acid of phosphorus or an oxide of phosphorus.

19. A low lead gasoline fuel containing at least 5 volume percent olefins and an additive in a sufficient amount to provide a dissolved phosphorus concentration of at least about 0.11 grams per gallon, said additive consisting essentially of the reaction product of an alcohol with an oxide of phosphorus further reacted with an amine.

20. A low lead gasoline fuel as defined in claim 19 wherein said oxide of phosphorus comprises phosphorus pentoxide.

21. A gasoline fuel composition comprising (1) an olefin-containing gasoline which causes an excessive wear rate of exhaust valve seats in an internal combustion engine containing non-hardened exhaust valve seats and (2) a sufficient amount of an amine salt of an ester of orthophosphoric acid to reduce the wear rate of said exhaust valve seats to a level no greater than that obtainable with tetraethyl lead provided to the same gasoline in a concentration of 0.1 gram of lead per gallon.

22. A gasoline fuel composition comprising (1) a gasoline containing at least 5 volume percent of olefins, which gasoline causes an excessive wear rate of exhaust valve seats in an internal combustion engine containing non-hardened exhaust valve seats and (2) a sufficient amount of an amine salt to provide a dissolved phosphorus concentration of at least 0.06 grams per gallon, said amine salt having the following formula:

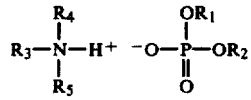

(I)

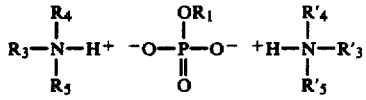

(II)

wherein $R_2$, $R_3$, and $R'_3$ are the same or different organic radicals of no more than 45 carbon atoms and $R_1$, $R_4$, $R'_4$, $R_5$, and $R'_5$ are independently selected from the group consisting of hydrogen and organic radicals of no more than 45 carbon atoms.

23. A gasoline fuel composition as defined in claim 22 wherein said amine salt is provided in an amount sufficient to provide a dissolved phosphorus concentration of at least 0.088 grams per gallon.

24. A gasoline fuel composition as defined in claim 22 wherein $R_2$, $R_3$, and $R'_3$ are the same or different aliphatic radicals containing no more than 35 carbon atoms and $R_1$, $R_4$, $R'_4$, $R_5$, and $R'_5$ are independently selected from the group consisting of hydrogen and aliphatic radicals containing no more than 35 carbon atoms.

25. A gasoline fuel composition as defined in claim 24 wherein said amine salt is provided in an amount sufficient to provide a dissolved phosphorus concentration of at least about 0.09 gram per gallon.

26. A gasoline fuel composition as defined in claim 24 wherein said amine salt is provided in said gasoline in an amount sufficient to provide a dissolved phosphorus concentration in the gasoline of at least about 0.12 gram per gallon.

27. A gasoline fuel composition as defined in claim 24 wherein $R_4$, $R'_4$, $R_5$, and $R'_5$ are all hydrogen.

28. A gasoline fuel composition as defined in claim 27 wherein said amine salt is provided in said gasoline in an amount sufficient to provide a dissolved phosphorus concentration in the gasoline of about 0.10 to about 0.30 gram per gallon.

29. A gasoline fuel composition as defined in claim 27 wherein $R_1$ is either hydrogen or an alkyl group and $R_2$ is an alkyl group.

30. A gasoline fuel composition as defined in claim 29 wherein said fuel contains less than 0.1 gram per gallon of lead and wherein said amine salt is provided in said gasoline in an amount sufficient to provide a dissolved phosphorus concentration in the gasoline of about 0.10 to about 0.30 gram per gallon.

31. A gasoline fuel composition as defined in claim 29 wherein $R_2$ is a branched chain alkyl group of at least 13 carbon atoms.

32. A gasoline fuel composition as defined in claim 31 wherein said amine salt is provided in an amount sufficient to provide a dissolved phosphorus concentration of at least about 0.09 gram per gallon.

33. A gasoline fuel composition as defined in claim 31 wherein $R_1$ is a branched chain alkyl group of at least 13 carbon atoms, with the branching in both $R_1$ and $R_2$ being at a location other than the carbon atom bonded to the oxygen atom.

34. A gasoline fuel composition as defined in claim 33 wherein said amine salt is provided in an amount in said gasoline to provide a dissolved phosphorus content in said gasoline of at least about 0.12 gram per gallon.

35. A gasoline fuel composition as defined in claim 33 wherein a carbon atom is bonded to the nitrogen atom in $R_3$ and $R'_3$, which carbon atom is fully saturated.

36. A gasoline fuel composition as defined in claim 35 wherein $R_3$ and $R'_3$ are alkyl groups.

37. A gasoline fuel composition as defined in claim 36 wherein $R_3$ and $R'_3$ are branched chain alkyl groups.

38. A gasoline fuel composition as defined in claim 37 wherein the branching in $R_3$ and $R'_3$ is at a location other than at the carbon atom bonded to the nitrogen atom.

39. An unleaded fuel composition comprising an olefin-containing gasoline and an additive for reducing exhaust valve seat wear, said additive consisting essentially of one or more amine salt of esters of orthophosphoric acid, which additive is present in said gasoline in an amount sufficient to provide a dissolved phosphorus concentration of at least about 0.09 gram per gallon.

40. An unleaded fuel composition as defined in claim 39 wherein said one or more amine salts comprise one or more amine salts of alkylacid esters of orthophosphoric acid.

41. An unleaded fuel composition as defined in claim 40 wherein said amine salts comprise one or more amine salts of branched chain alkyl acid esters of orthophosphoric acid.

42. An unleaded fuel composition as defined in claim 41 wherein said amine salts comprise one or more amine salts of branched chain primary alkyl acid esters of orthophosphoric acid.

43. The method comprising operating an internal combustion engine containing non-hardened exhaust valve seats using as a fuel for said engine the composition of claim 1.

44. A method for reducing the wear rate of non-hardened exhaust valve seats in an automotive internal combustion engine by operating said engine with the gasoline fuel of claim 3.

45. A method for preventing erosion of cast iron exhaust valve seats in an internal combustion engine operating on a low lead gasoline, said method comprising operating said engine with the gasoline fuel defined in claim 5.

46. A method for reducing the wear rate of non-hardened exhaust valve seats in an automotive internal combustion engine by operating said engine with the gasoline fuel of claim 8.

47. A method for reducing the wear rate of non-hardened exhaust valve seats in an automotive internal combustion engine by operating said engine with the gasoline fuel of claim 11.

48. A method for reducing the wear rate of non-hardened exhaust valve seats in an automotive internal combustion engine by operating said engine with the gasoline fuel of claim 15.

49. A method for reducing the wear rate of non-hardened exhaust valve seats in an automotive internal combustion engine by operating said engine with the gasoline fuel of claim 20.

50. A method for reducing the wear rate of non-hardened exhaust valve seats in an automotive internal combustion engine by operating said engine with the gasoline fuel composition of claim 21.

51. A method for reducing the wear rate of non-hardened exhaust valve seats in an automotive internal combustion engine by operating said engine with the gasoline fuel composition of claim 25.

52. A method for reducing the wear rate of non-hardened exhaust valve seats in an automotive internal combustion engine by operating said engine with the gasoline fuel composition of claim 30.

53. A method for reducing the wear rate of non-hardened exhaust valve seats in an automotive internal combustion engine by operating said engine with the gasoline fuel composition of claim 31.

54. A method for reducing the wear rate of non-hardened exhaust valve seats in an automotive, spark ignition, internal combustion engine by operating said engine with the gasoline fuel compostion of claim 36.

55. A method for reducing the wear rate of non-hardened exhaust valve seats in an automotive internal combustion engine by operating said engine with the gasoline fuel composition of claim 38.

56. A method for reducing the wear rate of non-hardened exhaust valve seats in an automotive internal combustion engine by operating said engine with the unleaded fuel composition of claim 39.

57. A method for reducing the wear rate of non-hardened exhaust valve seats in an automotive internal combustion engine by operating said engine with the unleaded fuel composition of claim 42.

58. A gasoline fuel as defined in claim 4 wherein said amine salt conforms to formula (I).

59. A gasoline fuel as defined in claim 5 wherein said amine salt conforms to formula (I).

60. A gasoline fuel as defined in claim 9 wherein said amine salt conforms to formula (I).

61. A gasoline fuel as defined in claim 11 wherein said amine salt conforms to formula (I).

62. A gasoline fuel as defined in claim 17 wherein said amine salt conforms to formula (I).

63. A gasoline fuel composition as defined in claim 23 wherein said amine salt conforms to formula (I).

64. A gasoline fuel composition as defined in claim 27 wherein said amine salt conforms to formula (I).

65. A gasoline fuel composition as defined in claim 33 wherein said amine salt conforms to formula (I).

66. A gasoline fuel composition as defined in claim 34 wherein said amine salt conforms to formula (I).

67. A gasoline fuel composition as defined in claim 38 wherein said amine salt conforms to formula (I).

68. A gasoline fuel as defined in claim 15 wherein said amine salt conforms to formula (I).

69. A gasoline fuel as defined in claim 14 wherein said amine salt conforms to formula (I).

70. A gasoline fuel composition comprising (1) a gasoline which causes an excessive wear rate of exhaust valve seats in an internal combustion engine containing non-hardened exhaust valve seats and (2) a sufficient amount of an amine salt to provide a dissolved phosphorus concentration of at least 0.12 gram per gallon, said amine salt having the following formula:

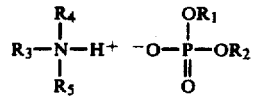

(I)

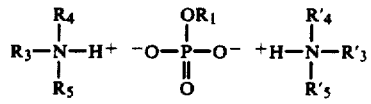

(II)

wherein $R_1$ is either hydrogen or an alkyl group, $R_2$ is a branched chain alkyl group of at least 13 carbon atoms, and $R_3$ and $R'_3$ are organic radicals, and $R_4$, $R'_4$, $R_5$, and $R'_5$ are independently selected from the group consisting of organic radicals and hydrogen.

71. A gasoline fuel composition as defined in claim 70 wherein $R_3$ and $R'_3$ are both aliphatic radicals and $R_4$, $R'_4$, $R_5$, and $R'_5$ are all hydrogen.

72. A gasoline fuel composition as defined in claim 71 wherein $R_1$ is a branched chain alkyl group, with the branching in both $R_1$ and $R_2$ being at a location other than the carbon atom bonded to the oxygen atom.

73. A gasoline fuel composition as defined in claim 72 wherein a carbon atom is bonded to the nitrogen atom in $R_3$ and $R'_3$, which carbon atom is fully saturated.

74. A gasoline fuel composition as defined in claim 73 wherein $R_3$ and $R'_3$ are branched chain alkyl groups.

75. A gasoline fuel composition as defined in claim 74 wherein said amine salt conforms to formula (I).

76. A gasoline fuel composition as defined in claim 73 wherein said amine conforms to formula (I).

77. A gasoline fuel composition as defined in claim 70 wherein said amine salt conforms to formula (I).

78. A gasoline fuel composition comprising (1) a gasoline which causes an excessive wear rate of exhaust valve seats in an internal combustion engine containing non-hardened valve seats and (2) a sufficient amount of an amine salt to provide a dissolved phosphorus concentration of at least about 0.09 gram per gallon, said amine salt having the following formula:

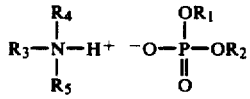

(I)

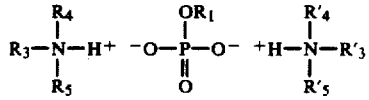

(II)

wherein $R_1$ is hydrogen or an organic radical other than an alkyl radical, $R_2$, $R_3$, and $R'_3$ are the same or different organic radicals, and $R_4$, $R'_4$, $R_5$, and $R'_5$ are independently selected from the group consisting of hydrogen and organic radicals.

79. A fuel composition as defined in claim 1 wherein said amine salt is present in a concentration of at least 160 pounds per thousand barrels.

80. A fuel composition as defined in claim 2 wherein said amine salt is present in a concentration of at least 200 pounds per thousand barrels.

81. A gasoline fuel as defined in claim 59 wherein said amine salt is present in a concentration of at least 160 pounds per thousand barrels.

82. A gasoline fuel as defined in claim 7 wherein said amine salt is present in a concentration of at least 200 pounds per thousand barrels.

83. A gasoline fuel as defined in claim 60 wherein said amine salt is present in a concentration of at least 160 pounds per thousand barrels.

84. A gasoline fuel as defined in claim 62 wherein said amine salt is present in a concentration of at least 200 pounds per thousand barrels.

85. A gasoline fuel as defined in claim 20 wherein said amine salt is present in a concentration of from about 200 to 750 pounds per thousand barrels.

86. A gasoline fuel composition as defined in claim 24 wherein said amine salt is present in a concentration of at least 200 pounds per thousand barrels.

87. A gasoline fuel composition as defined in claim 67 wherein said amine salt is present in a concentration of at least 200 pounds per thousand barrels.

88. An unleaded fuel composition as defined in claim 42 wherein said amine salt is present in a concentration of at least 200 pounds per thousand barrels.

89. A method for reducing the wear rate of non-hardened exhaust valve seats in an automotive, spark ignition, internal combustion engine by operating said engine with the fuel composition of claim 79.

90. A method for reducing the wear rate of non-hardened exhaust valve seats in an automotive, spark ignition, internal combustion engine by operating said engine with the fuel composition of claim 80.

91. A method for reducing the wear rate of non-hardened exhaust valve seats in an automotive, spark ignition, internal combustion engine by operating said engine with the gasoline fuel of claim 82.

92. A method for reducing the wear rate of non-hardened exhaust valve seats in an automotive, spark ignition, internal combustion engine by operating said engine with the gasoline fuel of claim 84.

93. A method for reducing the wear rate of non-hardened exhaust valve seats in an automotive, spark ignition, internal combustion engine by operating said engine with the gasoline fuel of claim 85.

94. A method for reducing the wear rate of non-hardened exhaust valve seats in an automotive, spark ignition, internal combustion engine by operating said engine with the gasoline fuel composition of claim 87.

95. A method for reducing the wear rate of non-hardened exhaust valve seats in an automotive, spark ignition, internal combustion engine by operating said engine with the unleaded composition of claim 88.

96. A method for reducing the wear rate of non-hardened exhaust valve seats in an automotive, spark ignition, internal combustion engine by operating said engine with the gasoline fuel of claim 83.

97. A fuel composition consisting essentially of:

(1) automotive unleaded gasoline and (2) a sufficient amount of an additive for reducing exhaust valve seat wear, said additive consisting essentially of an amine salt having the formula:

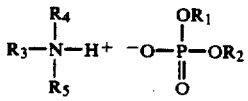

(I)

-continued

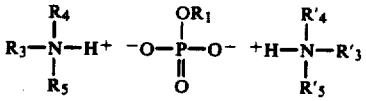

(II)

wherein $R_2$, $R_3$, and $R'_3$ are the same or different organic radicals of no more than 45 carbon atoms and $R_1$, $R_4$, $R'_4$, $R_5$, and $R'_5$ are independently selected from the group consisting of hydrogen and organic radicals of no more than 45 carbon atoms, said additive being present in an amount sufficient to provide a dissolved phosphorus concentration of at least 0.088 grams per gallon.

98. A fuel composition as defined in claim 97 wherein said additive is present in a concentration of at least 200 pounds per thousand barrels.

99. A fuel composition as defined in claim 98 wherein $R_1$ and $R_2$ are both branched chain alkyl radicals, with the branching occurring at a location other than at the carbon atom bonded to the oxygen atom.

100. A fuel composition as defined in claim 99 wherein $R_1$ and $R_2$ each contains at least 13 carbon atoms and $R_3$ and $R'_3$ are aliphatic radicals with there being a fully saturated carbon atom bonded to the nitrogen atom.

101. A fuel composition as defined in claim 100 wherein $R_3$ and $R'_3$ are both alkyl groups and $R_4$, $R'_4$, $R_5$, and $R'_5$ are all hydrogen.

102. A fuel composition as defined in claim 101 wherein $R_3$ and $R'_3$ both contain from 8 to 18 carbon atoms.

103. A fuel composition as defined in claim 102 wherein $R_3$ and $R'_3$ are both branched chain alkyl groups.

104. A fuel composition as defined in claim 103 wherein the additive conforms to formula (I).

105. A fuel composition as defined in claim 98 wherein the additive conforms to formula (I).

106. A fuel composition as defined in claim 100 wherein the additive conforms to formula (I).

107. A fuel composition as defined in claim 102 wherein the additive conforms to formula (I).

108. A method for reducing the wear rate of non-hardened exhaust valve seats in an automotive, spark ignition, internal combustion engine by operating said engine with the fuel composition of claim 98.

109. A method for reducing the wear rate of non-hardened exhaust valve seats in an automotive, spark ignition, internal combustion engine by operating said engine with the fuel composition of claim 103.

110. A method for reducing the wear rate of non-hardened exhaust valve seats in an automotive, spark ignition, internal combustion engine by operating said engine with the fuel composition of claim 100.

111. A method for reducing the wear rate of non-hardened exhaust valve seats in an automotive, spark ignition, internal combustion engine by operating said engine with the fuel composition of claim 102.

112. A method for reducing the wear rate of non-hardened exhaust valve seats in an automotive, spark ignition, internal combustion engine by operating said engine with the fuel composition of claim 104.

113. A method for reducing the wear rate of non-hardened exhaust valve seats in an automotive, spark ignition, internal combustion engine by operating said engine with the fuel composition of claim 105.

114. A gasoline fuel as defined in claim 4 wherein $R_3$ and $R'_3$ are branched chain groups.

115. A gasoline fuel as defined in claim 5 wherein $R_3$ is a branched chain group and said amine salt conforms to formula (I).

116. A gasoline fuel as defined in claim 7 wherein $R_3$ is a branched chain group and said amine salt conforms to formula (I).

117. A gasoline fuel as defined in claim 13 wherein $R_3$ is a branched chain group and said amine salt conforms to formula (I).

118. A gasoline fuel as defined in claim 17 wherein $R_3$ is a branched chain alkyl group and said amine salt conforms to formula (I).

119. A gasoline fuel composition as defined in claim 23 wherein $R_3$ is a branched chain group and said amine salt conforms to formula (I).

120. A gasoline fuel composition as defined in claim 27 wherein $R_3$ is a branched chain group and said amine salt conforms to formula (I).

121. A gasoline fuel composition as defined in claim 33 wherein $R_3$ is a branched chain group and said amine salt conforms to formula (I).

122. A method for reducing the wear rate of non-hardened exhaust valve seats in an automotive, spark ignition, internal combustion engine by operating said engine with the gasoline fuel of claim 115.

123. A method for reducing the wear rate of non-hardened exhaust valve seats in an automotive, spark ignition, internal combustion engine by operating said engine with the gasoline fuel of claim 116.

124. A method for reducing the wear rate of non-hardened exhaust valve seats in an automotive, spark ignition, internal combustion engine by operating said engine with the gasoline fuel of claim 118.

125. A method for reducing the wear rate of non-hardened exhaust valve seats in an automotive, spark ignition, internal combustion engine by operating said engine with the gasoline fuel composition of claim 119.

126. A gasoline fuel as defined in claim 4 wherein said amine salt conforms to formula (II).

127. A gasoline fuel as defined in claim 10 wherein said amine salt conforms to formula (II).

128. A gasoline fuel as defined in claim 127 wherein $R_3$, $R'_3$, and $R_1$ are all branched chain alkyl radicals.

129. A gasoline fuel as defined in claim 128 wherein $R_1$ contains at least 13 carbon atoms.

130. A gasoline fuel as defined in claim 9 wherein $R_4$, $R_5$, $R'_4$, and $R'_5$ are all hydrogen, and $R_1$, $R_3$ and $R'_3$ are all branched chain alkyl radicals, and $R_1$ contains at least 13 carbon atoms, and the amine salt conforms to formula (II).

131. A gasoline fuel as defined in claim 127 wherein said amine salt is present in a concentration of at least 200 pounds per thousand barrels.

132. A gasoline fuel as defined in claim 130 wherein said amine salt is present in a concentration of at least 200 pounds per thousand barrels.

133. A gasoline fuel as defined in claim 14 wherein $R_3$ is a branched chain group and said amine salt conforms to formula (I).

134. A gasoline fuel as defined in claim 16 wherein $R_3$ is a branched chain group and said amine salt conforms to formula (I).

135. A gasoline fuel composition as defined in claim 33 wherein $R_3$ is a banched chain group and said amine salt conforms to formula (I).

136. A fuel composition as defined in claim 104 wherein $R_1$ and $R_2$ each contains between 16 and 33 carbon atoms.

137. A fuel composition as defined in claim 136 wherein $R_3$ is an ethylhexyl group and said gasoline contains at least 5 volume percent of olefins.

138. A fuel composition as defined in claim 137 wherein $R_3$ is 2-ethylhexyl and said gasoline contains at least 7 volume percent olefins.

139. A fuel composition consisting of automotive unleaded gasoline and, as essentially the only components therein for reducing exhaust valve seat wear, one or more amine salts of formula:

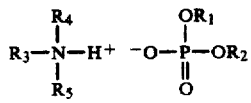

(I)

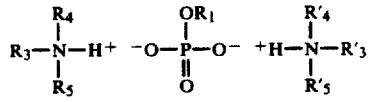

(II)

wherein $R_2$, $R_3$, and $R'_3$ are the same or different organic radicals of no more than 45 carbon atoms and $R_1$, $R_4$, $R'_4$, $R_5$, and $R'_5$ are independently selected from the group consisting of hydrogen and organic radicals of no more than 45 carbon atoms, said salt being present in a concentration greater than 160 lbs./1,000 bbl. so as to provide at least 0.088 grams of phosphorus per gallon.

140. A fuel composition as defined in claim 139 wherein said salt is present in a concentration of at least 200 pounds per thousand barrels.

141. A fuel composition as defined in claim 140 wherein said salt conforms to formula (I) and $R_1$ and $R_2$ are both branched chain alkyl radicals, with the branching occurring at a location other than at the carbon atom bonded to the oxygen atom.

142. A fuel composition as defined in claim 141 wherein $R_1$ and $R_2$ each contains at least 13 carbon atoms and $R_3$ is an aliphatic radical with there being a fully saturated carbon atom bonded to the nitrogen atom.

143. A fuel composition as defined in claim 142 wherein $R_3$ is an alkyl group and $R_4$ and $R_5$ are both hydrogen.

144. A fuel composition as defined in claim 143 wherein $R_3$ contains from 8 to 18 carbon atoms.

145. A fuel composition as defined in claim 144 wherein $R_3$ is a branched chain alkyl group.

146. A fuel composition as defined in claim 145 wherein $R_1$ and $R_2$ each contains at least 16 and 33 carbon atoms.

147. A fuel composition as defined in claim 146 wherein $R_3$ is an ethylhexyl group and said gasoline contains at least 5 volume percent of olefins.

148. A fuel composition as defined in claim 147 wherein $R_3$ is 2-ethylhexyl and said gasoline contains at least 7 volume percent olefins.

149. A fuel composition as defined in claim 139 wherein at least one of $R_1$ and $R_2$ contains at least 13 carbon atoms.

150. A fuel composition consisting of:

(1) automotive unleaded gasoline, and (2) one or more amine salts having the formula:

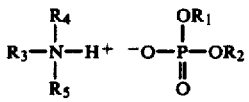

(I)

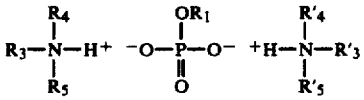

(II)

wherein $R_2$, $R_3$, and $R'_3$ are the same or different organic radicals of no more than 35 carbon atoms and $R_1$, $R_4$, $R'_4$, $R_5$, and $R'_5$ are independently selected from the group consisting of hydrogen and organic radicals of no more than 35 carbon atoms, said one or more amine salts being present in a concentration greater than 160 lbs./1,000 bbl. so as to provide a dissolved phosphorus concentration of at least 0.088 grams per gallon.

151. A fuel composition as defined in claim 150 wherein said salt is present in a concentration of at least 200 pounds per thousand barrels.

152. A fuel composition as defined in claim 151 wherein said salt conforms to formula (I) and $R_1$ and $R_2$ are both branched chain alkyl radicals, with the branching occurring at a location other than at the carbon atom bonded to the oxygen atom.

153. A fuel composition as defined in claim 152 wherein $R_1$ and $R_2$ each contains at least 13 carbon atoms and $R_3$ is an aliphatic radical with there being a fully saturated carbon atom bonded to the nitrogen atom.

154. A fuel composition as defined in claim 153 wherein $R_3$ is an alkyl group and $R_4$ and $R_5$ are both hydrogen.

155. A fuel composition as defined in claim 154 wherein $R_3$ contains from 8 to 18 carbon atoms.

156. A fuel composition as defined in claim 155 wherein $R_3$ is a branched chain alkyl group.

157. A fuel composition as defined in claim 156 wherein $R_1$ and $R_2$ each contains between 16 and 33 carbon atoms.

158. A fuel composition as defined in claim 157 wherein $R_3$ is an ethylhexyl group and said gasoline contains at least 5 volume percent of olefins.

159. A fuel composition as defined in claim 158 wherein $R_3$ is 2-ethylhexyl and said gasoline contains at least 7 volume percent olefins.

160. A method for reducing the wear rate of nonhardened exhaust valve seats in an automotive, spark ignition, internal combustion engine by operating said engine with the fuel composition of claim 138.

161. A method for reducing the wear rate of nonhardened exhaust valve seats in an automotive, spark ignition, internal combustion engine by operating said engine with the fuel composition of claim 146.

162. A method for reducing the wear rate of nonhardened exhaust valve seats in an automotive, spark ignition, internal combustion engine by operating said engine with the fuel composition of claim 148.

163. A method for reducing the wear rate of nonhardened exhaust valve seats in an automotive, spark ignition, internal combustion engine by operating said engine with the fuel composition of claim 149.

164. A method for reducing the wear rate of nonhardened exhaust valve seats in an automotive, spark ignition, internal combustion engine by operating said engine with the fuel composition of claim 150.

165. A method for reducing the wear rate of nonhardened exhaust valve seats in an automotive, spark ignition, internal combustion engine by operating said engine with the fuel composition of claim 156.

166. A method for reducing the wear rate of nonhardened exhaust valve seats in an automotive, spark ignition, internal combustion engine by operating said engine with the fuel composition of claim 159.

167. A method for reducing the wear rate of nonhardened exhaust valve seats in an automotive, spark ignition, internal combustion engine by operating said engine with the fuel composition of claim 157.

168. A fuel composition consisting of:

(1) unleaded gasoline suitable for combustion in an automobile engine; and (2) an additive consisting essentially of one or more amine salts having the formula:

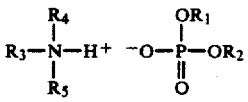

(I)

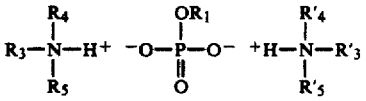

(II)

wherein $R_2$, $R_3$, and $R'_3$ are the same or different organic radicals of no more than 50 carbon atoms and $R_1$, $R_4$, $R'_4$, $R_5$, and $R'_5$ are independently selected from the group consisting of hydrogen and organic radicals of no more than 45 carbon atoms, said one or more amine salts being present in a concentration greater than 160 lbs./1,000 bbl. so as to provide a dissolved phosphorus concentration of at least 0.088 grams per gallon.

169. A fuel composition as defined in claim 168 wherein said salt is present in a concentration of at least 200 pounds per thousand barrels.

170. A fuel composition as defined in claim 169 wherein said salt conforms to formula (I) and $R_1$ and $R_2$ are both branched chain alkyl radicals, with the branching occurring at a location other than at the carbon atom bonded to the oxygen atom.

171. A fuel composition as defined in claim 170 wherein $R_1$ and $R_2$ each contains at least 13 carbon atoms and $R_3$ is an aliphatic radical with there being a fully saturated carbon atom bonded to the nitrogen atom.

172. A fuel composition as defined in claim 171 wherein $R_3$ is an alkyl group and $R_4$ and $R_5$ are both hydrogen.

173. A fuel composition as defined in claim 172 wherein $R_3$ contains from 8 to 18 carbon atoms.

174. A fuel composition as defined in claim 173 wherein $R_3$ is a branched chain alkyl group.

175. A fuel composition as defined in claim 174 wherein $R_1$ and $R_2$ each contains at least 16 carbon atoms.

176. A fuel composition as defined in claim 175 wherein $R_3$ is an ethylhexyl group and said gasoline contains at least 5 volume percent of olefins.

177. A fuel composition as defined in claim 176 wherein $R_3$ is 2-ethylhexyl and said gasoline contains at least 7 volume percent olefins.

178. A method for reducing the wear rate of nonhardened exhaust valve seats in an automotive, spark ignition, internal combustion engine by operating said engine with the fuel composition of claim 177.

179. A method for reducing the wear rate of nonhardened exhaust valve seats in an automotive, spark ignition, internal combustion engine by operating said engine with the fuel composition of claim 175.

180. A method for reducing the wear rate of nonhardened exhaust valve seats in an automotive, spark ignition, internal combustion engines by operating said engine with the fuel composition of claim 168.

181. A fuel composition as defined in claim 168 wherein said additive consists of said one or more amine salts.

182. A fuel composition as defined in claim 177 wherein said additive consists of said one or more amine salts.

183. A fuel composition as defined in claim 175 wherein said additive consists of said one or more amine salts.

184. A method for reducing the wear rate of nonhardened exhaust valve seats in an automotive, spark ignition, internal combustion engines by operating said engine with the fuel composition of claim 181.

185. A method for reducing the wear rate of nonhardened exhaust valve seats in an automotive, spark ignition, internal combustion engine by operating said engine with the fuel composition of claim 182.

186. A method for reducing the wear rate of nonhardened exhaust valve seats in an automotive, spark ignition, internal combustion engine by operating said engine with the fuel composition of claim 183.

187. A fuel composition as defined in claim 139 wherein said amine salt is present in a concentration from about 275 to 550 lb./1,000 bbl. and the phosphorus concentration provided by said salt is at least 0.15 gm./gal.

188. A fuel composition as defined in claim 148 wherein said amine salt is present in a concentration from about 275 to 550 lb./1,000 bbl. and the phosphorus concentration provided by said salt is at least 0.15 gm./gal.

189. A fuel composition as defined in claim 149 wherein said amine salt is present in a concentration from about 275 to 550 lb./1,000 bbl. and the phosphorus concentration provided by said salt is at least 0.15 gm./gal.

190. A fuel composition as defined in claim 157 wherein said amine salt is present in a concentration from about 275 to 550 lb./1,000 bbl. and the phosphorus concentration provided by said salt is at least 0.15 gm./gal.

191. A fuel composition as defined in claim 168 wherein said amine salt is present in a concentration from about 275 to 550 lb./1,000 bbl. and the phosphorus concentration provided by said salt is at least 0.15 gm./gal.

192. A fuel composition as defined in claim 171 wherein said amine salt is present in a concentration from about 275 to 550 lb./1,000 bbl. and the phosphorus concentration provided by said salt is at least 0.15 gm./gal.

193. A fuel composition as defined in claim 181 wherein said amine salt is present in a concentration from about 275 to 550 lb./1,000 bbl. and the phosphorus concentration provided by said salt is at least 0.15 gm./gal.

194. A fuel composition as defined in claim 182 wherein said amine salt is present in a concentration from about 275 to 550 lb./1,000 bbl. and the phosphorus concentration provided by said salt is at least 0.15 gm./gal.

195. A fuel composition as defined in claim 183 wherein said amine salt is present in a concentration from about 275 to 550 lb./1,000 bbl. and the phosphorus concentration provided by said salt is at least 0.15 gm./gal.

196. A method for reducing the wear rate of nonhardened exhaust valve seats in an automotive, spark ignition, internal combustion engine by operating said engine with the fuel composition of claim 195.

197. A method as defined in claim 196 wherein said gasoline contains at least 5 volume percent olefins.

198. A method for reducing the wear rate of nonhardened exhaust valve seats in an automotive, spark ignition, internal combustion engine by operating said engine with the fuel composition of claim 194.

199. A fuel composition as defined in claim 1 wherein said amine salt is present in a concentration from about 275 to 550 lb./1,000 bbl. and the phosphorus concentration provided by said salt is at least 0.15 gm./gal.

200. A fuel composition as defined in claim 70 wherein said amine salt is present in a concentration from about 275 to 550 lb./1,000 bbl. and the phosphorus concentration provided by said salt is at least 0.15 gm./gal.

201. A method for reducing wear in the exhaust valve seats of an automotive engine, said engine having nonhardened exhaust valve seats, comprising operating said engine with an unleaded gasoline fuel containing, as essentially the only components therein for reducing the wear rate of said exhaust valve seats, one or more amine salts of formula

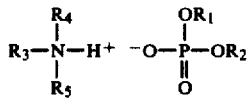

(I)

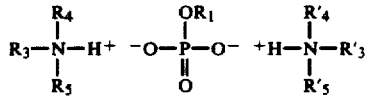

(II)

wherein $R_2$, $R_3$, and $R'_3$ are the same or different organic radicals of no more than 45 carbom atoms and $R_1$, $R_4$, $R'_4$, $R_5$, and $R'_5$ are independently selected from the group consisting of hydrogen and organic radicals of no more than 45 carbom atoms; said salt being present in a concentration greater than 200 lbs/1,000 bbl so as to provide a phosphorus concentration of at least 0.11 gm/gal such that the wear rate is reduced (1) to below that provided by tricresyl phosphate in an equivalent phosphorus concentration, (2) by at least about 83% in comparison to the unleaded fuel itself, and (3) to a level no greater than that obtainable with tetraethyllead at 0.1 gm/gal.

202. A method as defined in claim 201 wherein the salt conforms to formula (I), $R_4$ and $R_5$ are both hydrogen, $R_3$ is a branched chain alkyl group of 8 to 18 carbon atoms, and $R_1$ and $R_2$ are branched chain alkyl groups each containing at least 13 carbon atoms, with the branching occurring at a location other than at the carbon atom bonded to the oxygen atom.

203. A method as defined in claim 202 wherein $R_3$ is 2-ethylhexyl and said gasoline contains at least 7 volume percent olefins.

204. A method as defined in claim 203 wherein said fuel consists of unleaded gasoline and said amine salts.

205. The method defined in claim 204 wherein the amine salt is present in a concentration from about 275 to 550 lb/1,000 bbl and the phosphorus concentration provided by said salt is at least 0.15 gm/gal.

206. The method defined in claim 202 wherein the amine salt is present in a concentration from about 275 to 550 lb/1,000 bbl and the phosphorus concentration provided by said salt is at least 0.15 gm/gal.

207. A method as defined in claim 202 wherein $R_1$ and $R_2$ are unsubstituted branched chain alkyl groups containing between 16 and 33 carbon atoms.

208. A method as defined in claim 204 wherein $R_1$ and $R_2$ are unsubstituted branched chain alkyl groups containing between 16 and 33 carbon atoms.

209. A method as defined in claim 205 wherein $R_1$ and $R_2$ are unsubstituted branched chain alkyl groups containing between 16 and 33 carbon atoms.

210. A method as defined in claim 206 wherein $R_1$ and $R_2$ are unsubstituted branched chain alkyl groups containing between 16 and 33 carbon atoms.

211. A method as defined in claim 207 wherein the amine salt is present in a concentration from about 400 to 550 lb/1,000 bbl and the phosphorus concentration provided by said salt is at least 0.225 gm/gal.

212. A method as defined in claim 46 wherein the amine salt is present in a concentration from about 400 to 550 lb/1,000 bbl and the phosphorus concentration provided by said salt is at least 0.225 gm/gal.

213. A method as defined in claim 51 wherein the amine salt is present in a concentration from about 400 to 550 lb/1,000 bbl and the phosphorus concentration provided by said salt is at least 0.225 gm/gal.

214. A method as defined in claim 201 wherein the amine salt is present in a concentration from about 400 to 550 lb/1,000 bbl and the phosphorus concentration provided by said salt is at least 0.225 gm/gal.

215. A method as defined in claim 208 wherein the amine salt is present in a concentration from about 400 to 550 lb/1,000 bbl and the phosphorus concentration provided by said salt is at least 0.225 gm/gal.

* * * * *

UNITED STATES PATENT AND TRADEMARK OFFICE

CERTIFICATE OF CORRECTION

PATENT NO. : 4,720,288

DATED : January 19, 1988

INVENTOR(S) : Michael C. Croudace and Ward W. Howland

It is certified that error appears in the above-identified patent and that said Letters Patent is hereby corrected as shown below:

In claims 4, 5, 9, 22, 70, 78, 97, 139, 150, 168, and 201, between Formulae (I) and (II) insert --or--.

Column 10, line 32, change "salt" to --salts--

Column 11, line 28, change "compostion" to --composition--.

Column 15, line 2, after "are" insert --both--.

Column 16, line 55, delete "and 33".

Column 18, line 33, change "45" to --50--.

Column 19, line 9, change "engines" to --engine--.

Column 19, line 22, change "engines" to --engine--.

Column 20, line 47, change "carbom" to --carbon--.

Signed and Sealed this

Twenty-first Day of June, 1988

*Attest:*

DONALD J. QUIGG

*Attesting Officer*

*Commissioner of Patents and Trademarks*